US005773934A

United States Patent [19]

Uhm

[11] Patent Number: 5,773,934

[45] Date of Patent: Jun. 30, 1998

[54] RESISTIVE WALL KLYSTRON AMPLIFIER HAVING GROUNDED DRIFT TUBE

[75] Inventor: Han S. Uhm, Potomac, Md.

[73] Assignee: The United States of America as represented by the Secretary of the Navy, Washington, D.C.

[21] Appl. No.: 627,156

[22] Filed: Apr. 3, 1996

Related U.S. Application Data

[63] Continuation of Ser. No. 419,486, Apr. 10, 1995, Pat. No. 5,581,154.

[51] Int. Cl.[6] ..... H01J 25/10

[52] U.S. Cl. ..... 315/5.39; 315/5.51; 330/45

[58] Field of Search ..... 315/5.39, 5.51; 330/44, 45

[56] References Cited

U.S. PATENT DOCUMENTS

| | | | |
|---|---|---|---|
| 2,253,080 | 8/1941 | Maslov | 315/5.39 |
| 2,740,917 | 4/1956 | Haeff | 330/45 X |
| 2,810,853 | 10/1957 | Beck | 315/5.39 X |
| 3,381,163 | 4/1968 | La Rue et al. | 315/5.39 |
| 5,386,177 | 1/1995 | Uhm | 330/45 X |
| 5,581,154 | 12/1996 | Uhm | 315/5.39 |

*Primary Examiner*—Benny T. Lee
*Attorney, Agent, or Firm*—John Forrest; Jacob Shuster

[57] ABSTRACT

Nonlinear current modulation of a relativistic electron beam is achieved by its propagation without interruption through a resistive wall type of drift tube assembly within a klystron amplifier. Maximized beam current modulation is thereby attained for a beam propagation distance within a shortened drift tube.

3 Claims, 3 Drawing Sheets

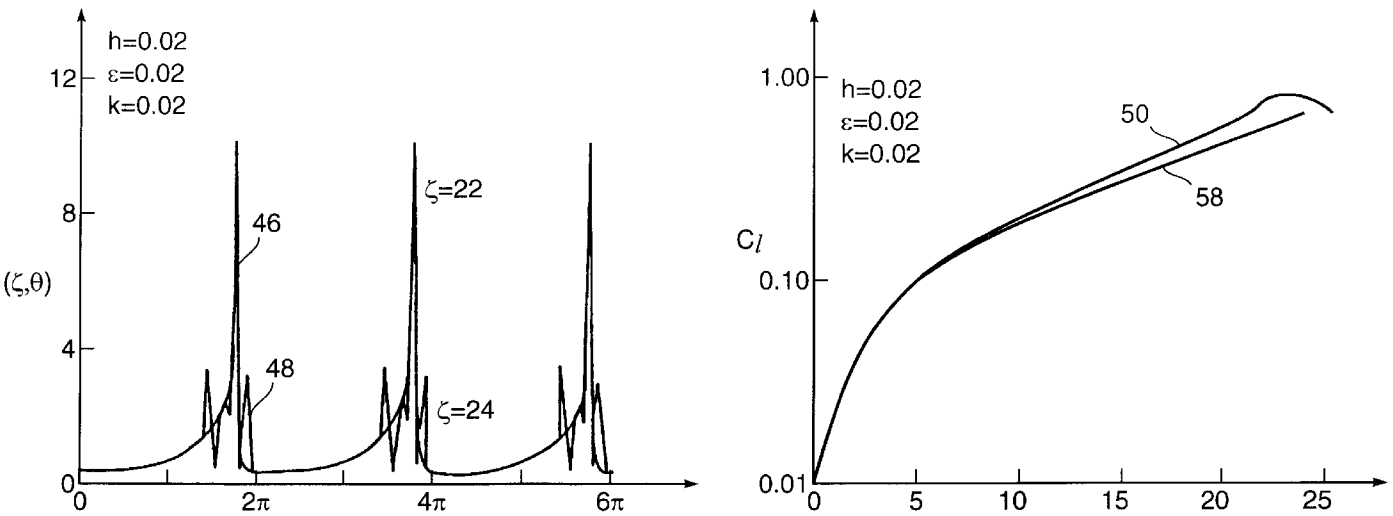
FIG. 5
FIG. 6
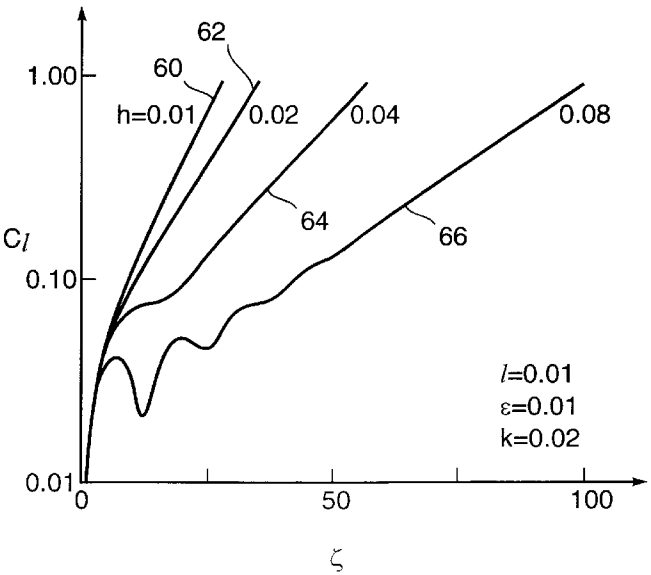
FIG. 7

RESISTIVE WALL KLYSTRON AMPLIFIER HAVING GROUNDED DRIFT TUBE

The present application is a continuation of Ser. No. 419,486 filed Apr. 10, 1995, now U.S. Pat. No. 5,581,154 issued Dec. 3, 1996.

BACKGROUND OF THE INVENTION

This invention relates generally to a klystron amplifier through which a relativistic electron beam is propagated between input and output cavities within a grounded drift tube having a resistive wall.

The propagation of a relativistic electron beam through the drift tube of a klystron device for amplification of microwave energy by beam current modulation is generally well known in the art as exemplified by Statutory Invention Registration H6 U.S. Pat. Nos. 4,480,210. 4,949,011 and 5,386,177 to Priest et al., Friedman et al., Mann and Uhm, respectively. According to such prior art, beam current modulation is deemed to be a linear function of drift tube distance between cavities. Thus, in an effort to reduce the overall length of the klystron amplifier in order to achieve a desired gain, drift tube propagation of the electron beam was interrupted by gaps intermediate the input and output cavities according to the teachings in the aforementioned patents to Priest et al., Friedman et al. and Mann. According to applicant's aforementioned prior patent to Uhm, interaction of the electron beam during propagation through a drift tube internally modified to enclose a body of dense plasma, is relied on to shorten drift tube distance between cavities.

It is therefore an important object of the present invention to provide a klystron amplifier through which drift tube propagation of a relativistic electron beam is conducted without interruption or internal drift tube modification to shorten distance between resonator cavities in order to obtain maximized beam current modulation.

SUMMARY OF THE INVENTION

In accordance with the present invention, an inner grounded drift tube extending without interruption between injection and extraction cavities of a klystron amplifier, is surrounded throughout by a resistive wall medium. Space charge waves are conducted through the resistive medium for interaction with the electron beam during propagation. A magnetic field generated by current conducted through an external winding coil, radially confines the electron beam within the inner drift tube while establishing an axial electric field within the resistive medium.

As a result of parameters readily attainable with the aforesaid resistive wall type of klystron amplifier, nonlinear beam current modulation is achieved during downstream electron beam propagation. Such beam current modulation is characterized by a reversal in initial dominance of the self-field effects over the resistive wall effects and a relatively large growth rate in resistive wall instability. The required drift tube length for maximized beam current modulation is thereby shortened. Also, the normalized power loss due to ohmic heating at the outer wall surface of the inner drift tube is typically less than ten percent.

BRIEF DESCRIPTION OF DRAWING FIGURES

A more complete appreciation of the invention and many of its attendant advantages will be readily appreciated as the same becomes better understood by reference to the following detailed description when considered in connection with the accompanying drawing wherein:

FIG. 5 is a graphical representation of variation in mode strength with respect to propagation distance based on the graphical representation depicted in FIGS. 2, 3 and 4;

FIG. 6 is another graphical representation of the microwave energy mode strength depicted in FIG. 4 and a graphical representation of a nonlinear mode evolution of the resistive wall shown in FIG. 1; and FIG. 7 are graphical representations of the microwave energy mode strength plotted against propagation distances corresponding to different field effects.

DETAILED DESCRIPTION OF PREFERRED EMBODIMENT

Figure 1:
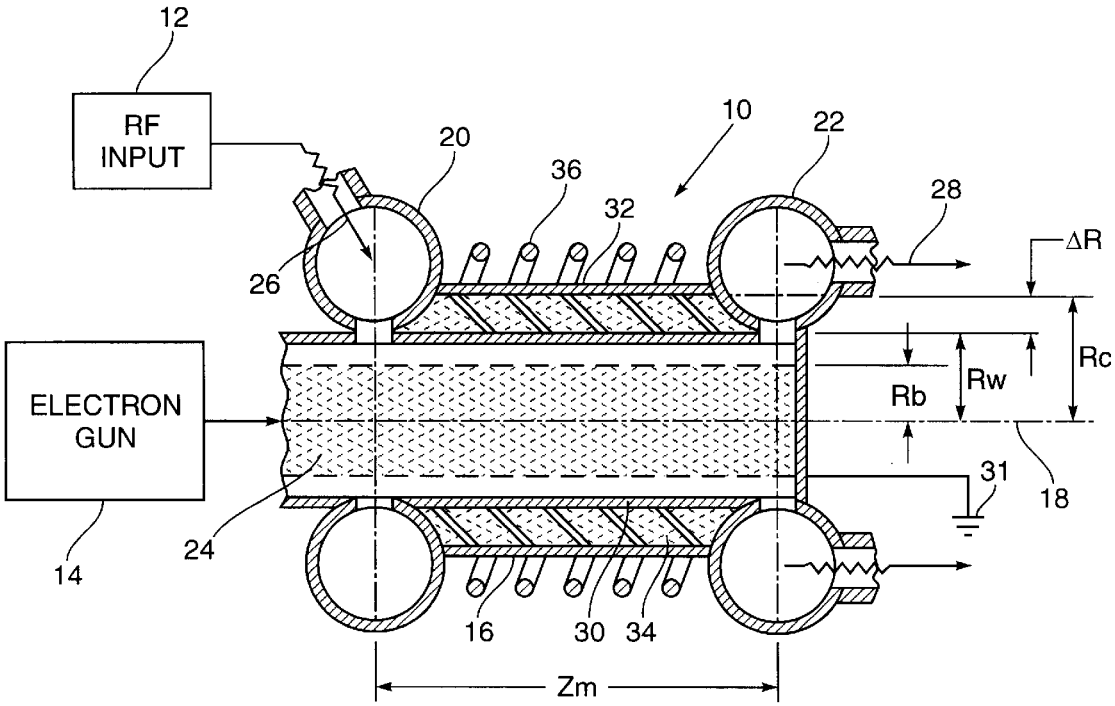
FIG. 1 is a side section view of a resistive wall type of klystron amplifier constructed in accordance with one embodiment of the present invention.

Referring now to the drawing in detail, FIG. 1 illustrates a klystron amplifier, generally referred to by reference numeral 10, to which microwave energy is fed from a RF input source 12 for interaction with a relativistic electron beam 24 from an electron gun 14. Such an arrangement is generally known in the art, except that in accordance with the present invention the klystron amplifier 10 involves use of a resistive wall type of drift tube assembly 16 extending continuously along axis 18 between first and second resonator cavities 20 and 22. The axial length of such drift tube assembly is shortened pursuant to the present invention even though the electron beam 24 is propagated along axis 18 within the drift tube without intermediate cavities, caps or internal devices. Microwave energy 26 from input source 12 is injected into the first cavity 20 at a velocity ($\beta_b$), while modulated microwave energy 28 is extracted from the second cavity 22 as depicted in FIG. 1.

As also shown in FIG. 1, the drift tube assembly 16 includes an inner cylindrical tube 30 that is electrically grounded as denoted by grounding designation 31 and has an internal radius (Rw) relative to the axis 18 of the klystron amplifier 10. Such tube 30 interconnects the cavities 20 and 22 to form an uninterrupted passage through which the relativistic electron beam 24 is propagated a distance (Zm) from the injection cavity 20 to the extraction cavity 22 for maximized beam current modulation. The inner tube 30 is externally coated by an outer cylindrical wrapping 32 made of electrically conductive material and having a radial distance the outer cylindrical wrapping extending (Rc) axially between the cavities 20 and 22 in coaxial relation to the inner tube 30 and a resistive medium 34 completely filling an annular passage formed by the wrapping about the inner tube 30. The resistive medium 34 has an electrical conductivity ($\sigma$), a permeability ($\mu$) and a thickness ($\Delta R$), where $\Delta R = Rc - Rw$. Thus, space charge waves initiated by self-excitation of the microwave energy 26 injected into cavity 20, is conducted through the resistive medium 34 during downstream propagation of the electron beam 24 to the extraction cavity 22 internally of the inner tube 30. The electron beam 24 is radially confined during such propagation to a radius (Rb), as shown in FIG. 1, by a strong magnetic field generated in response to electrical current having an oscillation frequency (w) conducted through winding coil 36, inducing an electric field within the drift tube assembly 16.

The resistive-wall type of drift tube assembly 16 as hereinbefore described, significantly affects current modulation of the electron beam 24 after being initially modulated at the location of injection cavity 20 from which it propagates downstream through the inner tube 30. Based on the aforementioned injection velocity ($\beta_b$) of the microwave energy 26, the oscillation frequency (w), the propagation distance (Z) along axis 18 and the speed of light (c), a normalized propagation distance ($\zeta$) is determined from the equation $\zeta=(w)(Z)(\beta_b)(C)$, in order to calculate normalized beam current (F) as a function of such normalized propagation distance ($\zeta$) and propagation time ($\theta$). Because of the interaction of the space charge waves aforementioned with the electron beam 24 during propagation, a highly nonlinear type of beam current modulation of the electron beam 24 occurs after initial modulation ($\epsilon$) of the injection energy ($\gamma_b$). Such non-linear current modulation is characterized by domination of self-field effects (h) over resistive-wall effects ($\kappa$) in the beginning of beam propagation at the injection cavity 20 reversing to domination by the resistive-wall effects ($\kappa$) as the beam propagates further downstream through the inner tube 30. A typical example of such normalized beam current modulation (F) varying between Imin and Imax is graphically depicted in FIG. 2 by curve 38 plotted against normalized propagation time ($\theta$) along a horizontal scale. Also plotted with respect to the time scale, is a curve 40 of beam energy ($\gamma$) graphically depicted as normalized kinetic energy along a separate vertical scale on the right hand side of the graph as denoted in FIG. 2. Data for such graphical representations of normalized beam current and kinetic energy is based on physical parameters of the klystron amplifier 10 which are easily attainable, such as $(\gamma_b)=1.5$, (h)=0.02, $(\epsilon)=0.02$ and $(\kappa)=0.02$, denoted in FIG. 2 for a normalized propagation distance ($\zeta$) of 21. Based on the same physical parameters (h), ($\epsilon$) and ($\kappa$), FIG. 3 plots curves 42 and 44 for comparison with curve 38 from FIG. 2, as graphical representations of normalized beam current (F) respectively corresponding to values of 22 and 24 for the normalized propagation distance ($\zeta$) as plotted in FIG. 5.

Figure 2:
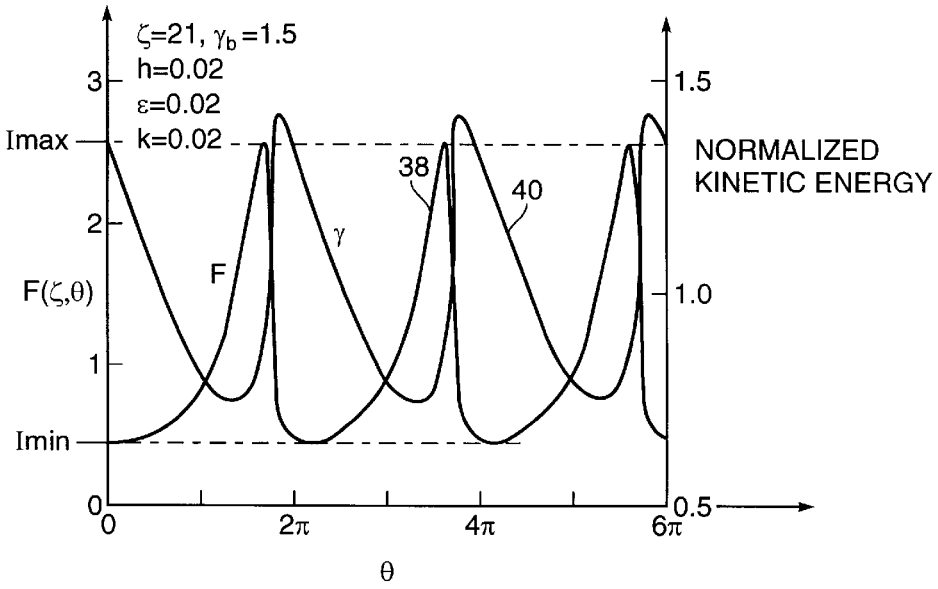
FIG. 2 is a graphical representation of normalized beam current and kinetic energy as operational characteristics of the klystron amplifier shown in FIG. 1.

It will be noted from FIG. 2 that the current profile of beam modulation reflected by curves 38 and 40 is very different from that of a sinusoidal wave form, even though energy modulation at the injection cavity 20 is a sinusoidal function. Also, the curve 38 has current peaks (I max) close to distances (Z) from cavity 20 occurring at times ($\theta$) when changes in energy with respect to time ($d\gamma/d\theta$) are locally maximized. From a comparison of beam current curves 38, 42 and 44 shown in FIG. 3 corresponding to propagation distances (C) of 21, 19 and 17, the locations of maximized beam current (I max) and minimized beam current (I min) shifts in the downstream direction of propagation with increase in normalized propagation distances ($\zeta$)respectively plotted as curves 46 and 48 in FIG. 5, manifesting a phase delay (W) as a function of($\zeta$) and ($\theta$) in the amplification of the modulated beam current. Based on such analysis of beam current modulation, graphically reflected in FIGS. 2 and 3, the foregoing referred to phase delay associated with beam current modulation is determined to be caused by field energy stored in the resistive medium 34 of the drift tube assembly 16 shown in FIG. 1.

Figure 4:
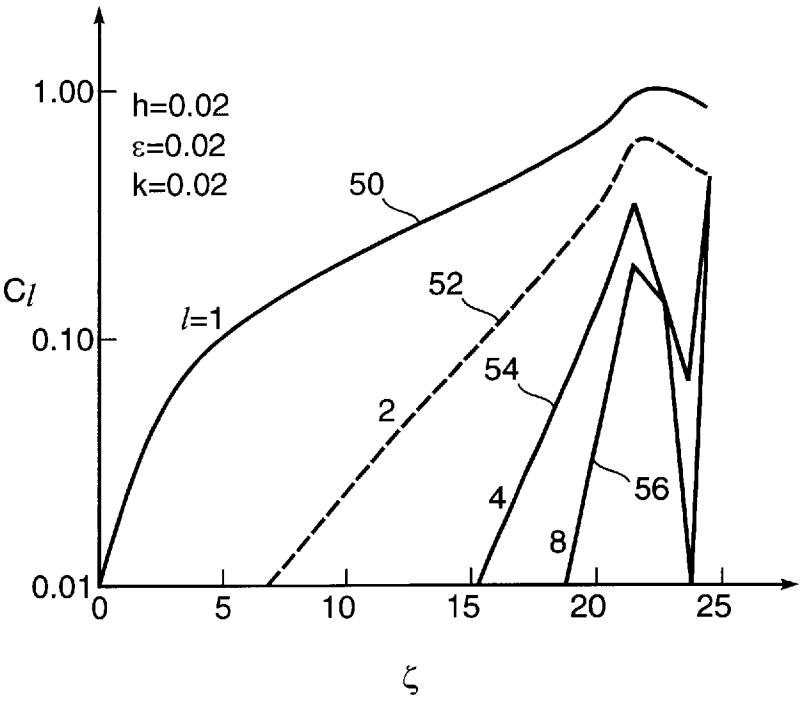
FIG. 4 is a graphical representation of the microwave energy mode strength corresponding to the normalized propagation distance.
Figure 3:
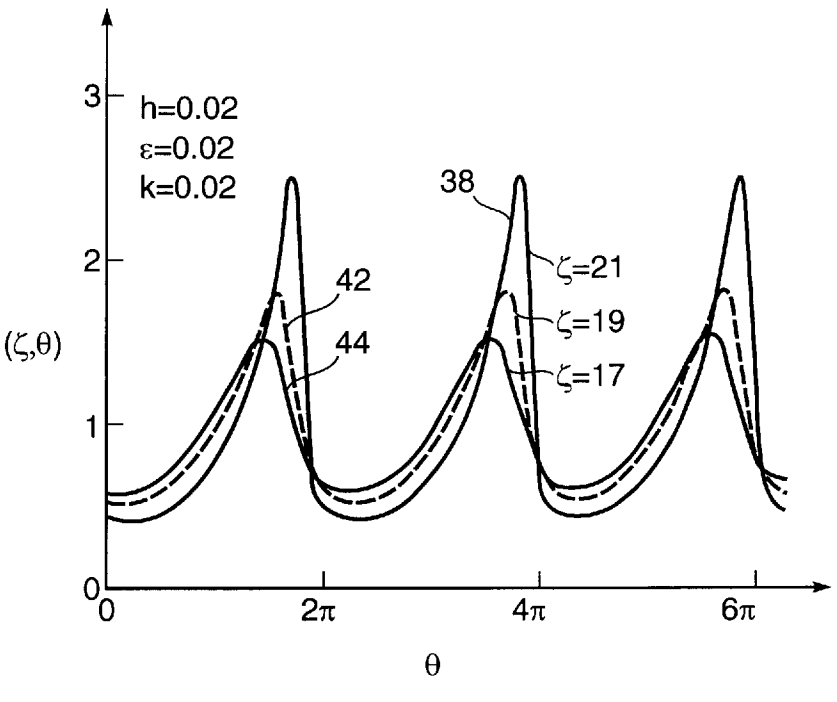
FIG. 3 is another graphical representation of the normalized beam current corresponding to a normalized propagation distance.

Also utilizing the same physical parameters (h), ($\epsilon$) and ($\kappa$) associated with the graphical representations in FIGS. 2 and 3, mode strength ($C_1$) of the microwave energy was plotted against propagation distance ($\zeta$) in FIG. 4 as curves 50. 52. 54 and 56 in order to investigate mode evolution for different mode numbers (l) of 1. 2, 4 and 8 respectively. Based on the foregoing graphical representations, mode strengths (Cl) grow exponentially with respect to propagation distance ($\zeta$) except where peak beam current modulation occurs at ($\zeta$m) equal to 22, as graphically depicted by curve 46 in FIG. 5 which also depicts curve 48 corresponding to a propagation distance equal to 24. From such analytical estimation of the value of ($\zeta$m), the length of the resistive-wall drift tube assembly 16 is determined as the propagation distance (Zm) at which maximum current modulation occurs.

The fundamental mode strength ($C_1$) reflected by curve 50 in FIG. 4 (where l=1), is also plotted in FIG. 6 for comparison with a curve 58 graphically representing nonlinear mode evolution of the resistive wall of the drift tube assembly 16 for the same property values of (h), ($\epsilon$) and ($\kappa$), wherein the mode strength ($C_1$) is proportional to $[\epsilon\zeta/2]^{1-1}$. For investigation of the influence of the self-field effects (h), curves 60, 62, 64 and 66 of fundamental mode strength ($C_1$) corresponding to different field effects values 0.01, 0.02, 0.04 and 0.08 for (h), were plotted against propagation distance ($\zeta$) in FIG. 7, where the initial energy gain value ($\epsilon$) is 0.01. As evident from FIG. 7, the exponential growth rate of the mode strength ($C_1$) decreases as the self-field effects (h) increases. Also, the fundamental mode strength ($C_1$) exhibits a restoring behavior at the beginning of propagation when the self-field effects (h) dominates over the resistive wall effects ($\kappa$) as reflected by curve 66. Finally, it is also evident from FIG. 7 that reduction in self-field effects (h) is essential for shortening the length of tube 30 to the distance (Zm) as shown in FIG. 1 at which current modulation of the electron beam 24 is maximized, corresponding to the normalized propagation distance ($\zeta$) for maximum beam current modulation which is inversely proportional to microwave energy frequency (w) because of its aforementioned definition, $$\zeta=\frac{wZ}{\beta_b C}.$$

Based on the evaluation of parameters, properties and characteristics associated with the resistive wall type klystron amplifier 10 as hereinbefore described and graphically plotted in FIGS. 2–7, the normalized power loss for the beam energy ($\gamma$) in the resistive medium 34 due to ohmic heating at the wall of tube 30 is typically less than 10% of the beam power, while the length (Zm) of the tube 30 for maximized beam current modulation is shortened by minimizing the self-field effects (h). An experimental model of such klystron amplifier 10 indicates by way of example that for a 10-GHz microwave frequency, a 15 cm long drift tube assembly 16 is attainable.

Obviously, other modifications and variations of the present invention may be possible in light of the foregoing teachings. It is therefore to be understood that within the scope of the appended claims the invention may be practiced otherwise than as specifically described.

What is claimed is:

1. In combination with a source of microwave energy, an electron gun generating a relativistic electron beam and a klystron device operatively connected to said electron gun and positioned relative thereto for propagation of the electron beam therethrough, said klystron device having a first cavity connected to said source, a second cavity from which the microwave energy is extracted after modulation with the electron beam during propagation from the first cavity to the second cavity; and an electrically grounded drift tube having a continuous wall construction extending between the first and second cavities to provide a passage within which said propagation of the electron beam occurs without interruption and support a resistive medium externally of said passage accommodating said propagation of the electron beam for a shortened distance at which said modulation of the electron beam is maximized.

2. The combination as defined in claim 1 further including magnetic field generating means for radially confining the electron beam to said passage in the drift tube during said propagation thereof and producing an axial electric field in the resistive medium having minimized self-field effects.

3. In combination with a source of microwave energy and a klystron device including: a source of electrons from which a relativistic electron beam is derived, a first cavity connected to said source of microwave energy, a second cavity from which the microwave energy is extracted after modulation with the electron beam during propagation from the first cavity to the second cavity; an electrically grounded drift tube having a continuous passage extending between said first and second cavities within which said propagation of the electron beam is confined; and external coating means on the drift tube within which an oscillating electric field is established externally of said continuous passage for affecting interaction of the microwave energy with the electron beam during said propagation thereof without interruption through the continuous passage of the drift tube.

* * * * *